US006450934B1

(12) United States Patent
Coombs

(10) Patent No.: US 6,450,934 B1
(45) Date of Patent: Sep. 17, 2002

(54) HIGH SPEED POST PROCESSING MACHINE

(75) Inventor: Peter M. Coombs, Tustin, CA (US)

(73) Assignee: Gradco Japan, Tokyo (JP)

( * ) Notice: Subject to any disclaimer, the term of this patent is extended or adjusted under 35 U.S.C. 154(b) by 0 days.

(21) Appl. No.: 09/412,937

(22) Filed: Oct. 5, 1999

(51) Int. Cl.[7] ..... B31B 1/68

(52) U.S. Cl. ..... 493/383; 493/384; 493/385; 270/58.12; 270/58.13; 270/58.27; 270/58.28

(58) Field of Search ..... 270/583.12, 58.13, 270/58.27, 58.28; 493/383, 384, 385

(56) References Cited

U.S. PATENT DOCUMENTS 5,098,074 A * 3/1992 Mandel et al.
5,385,340 A * 1/1995 Hiroi et al.
5,622,359 A * 4/1997 Kawano et al.
5,634,632 A * 6/1997 Ruruya et al.
5,649,695 A * 7/1997 Lawrence

* cited by examiner

*Primary Examiner*—Eugene Kim

(57) ABSTRACT

A sheet post processing machine has a first shelf for assembling a number of sheets without causing any inhibition to the speed of sheet delivery from a host printer or copier, and the assembled sheets are dumped from the first shelf to a second shelf at which the sheets are collected in sets, jogged into edge alignment, stapled at the corners or along an edge, the sets are offset from one another, and finally, dumped from the second shelf onto a stacker tray.

10 Claims, 8 Drawing Sheets

HIGH SPEED POST PROCESSING MACHINE

BACKGROUND OF THE INVENTION

With the advent of printers and digital copiers which produce sets or jobs at a high page per minute rate of production of printed sheets, there has become an increasing need for post processing machines which interface with the printer or copier and which function to collect the sheets into sets or jobs and finish the sets or jobs by stapling at either of the corners or, if desired, along the edge of a set or job.

On certain machines known in the prior art, the post processing machine also performs hole punching operations to enable the set of sheets or job to be bound into loose leaf binders, after having been stapled or not.

PRIOR ART

The need for assembling sheets in an assembly station prior to post processing is recognized in Lawrence U.S. Pat. No. 5,649,695, granted Jul. 22, 1997, wherein the machine is capable of continuously assembling sheets in an assembly station, and retracting a support from the trailing end of the sheets while gripping the sets and moving them into a finishing station before releasing the grip on the set and depositing the finished set on a tray.

In Canon U.S. Pat. No. 5,385,340, granted Jan. 31, 1995, for example, it is recognized that sheets may be assembled partially on a stacker tray and partially on a fixed shelf in a position for post processing, and then the processed sets may be pushed or displaced from the fixed shelf to the stacker tray.

In Coombs application, Ser. No. 280,599, filed Mar. 29, 1999 and co-owned herewith, it is recognized that sheets may be assembled on a stacker tray and on a shelf on which the sets of sheets are finished, as by stapling at their trailing end, and the stapled set is then dropped or dumped for dropping the set from the shelf completely onto a stacker tray.

In Coombs application, Ser. No. 078,202, filed May 14, 1998 and co-owned herewith, there is shown a sequentially operated apparatus in which sets of sheets or a job are assembled on a first tray which is then opened to drop sheets to a second tray for finishing. The second tray opens to drop the finished set onto a stacker tray.

SUMMARY OF THE INVENTION

The present invention relates to utilization of two stations, each having a shelf which is capable of being dumped. On the top shelf sheets are assembled in a number which may be less than an entire set so that as subsequent sheets making up a complete set are fed to the top shelf and dumped to the lower second shelf on which the completed set may be finished, so as to ultimately create a completed set, while additional sheets used in the composition of the next set are being fed onto the top shelf.

While the first referred to set is on the second shelf, the sheets can be progressively jogged into edge alignment, stapled, offset, if desired, and then dumped onto a stacker tray.

In such an apparatus, using a punch mechanism as the sheets are being fed to the top shelf, the sheets can also be punched on the fly so as to not inhibit the speed of input of the sheets from the printer or copier to the top shelf.

In the case that the sheets require inversion, which is a function of whether the sheet is exiting the printer or copier face up or face down, the post processing machine of the invention can include a simple inverter structure located so as to invert the sheets as they exit the printer or copier without inhibiting the speed of the printer or copier itself.

DESCRIPTION OF THE PREFERRED EMBODIMENT

Figure 1:
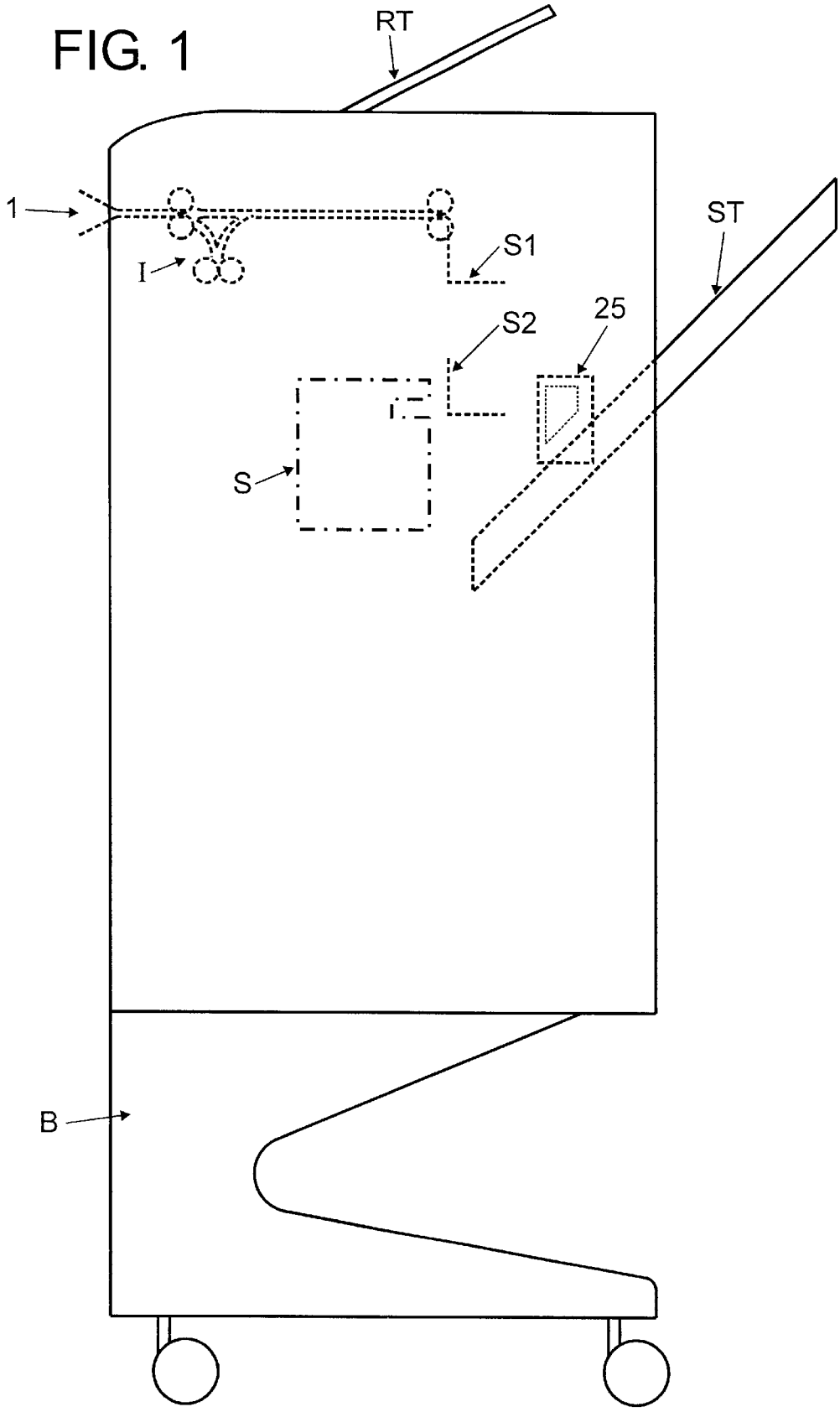
FIG. 1 is a side elevation of the apparatus of the invention.

In FIG. 1, there is shown an apparatus according to the invention including infeed means 1 having an inverter I and a paper feed path having appropriately drives feed rolls for delivering sheets to a first shelf S1, a lower shelf S1, a stapler S for finishing sheets on shelf S2 and a stacker tray ST for receiving finished sets.

The apparatus may also have an upper receiving tray RT and a wheeled based support B to position the apparatus appropriately in relation to a printing or copying machine. In other cases the apparatus of the invention may be mounted upon the printer or copier or otherwise supported.

Figure 2:
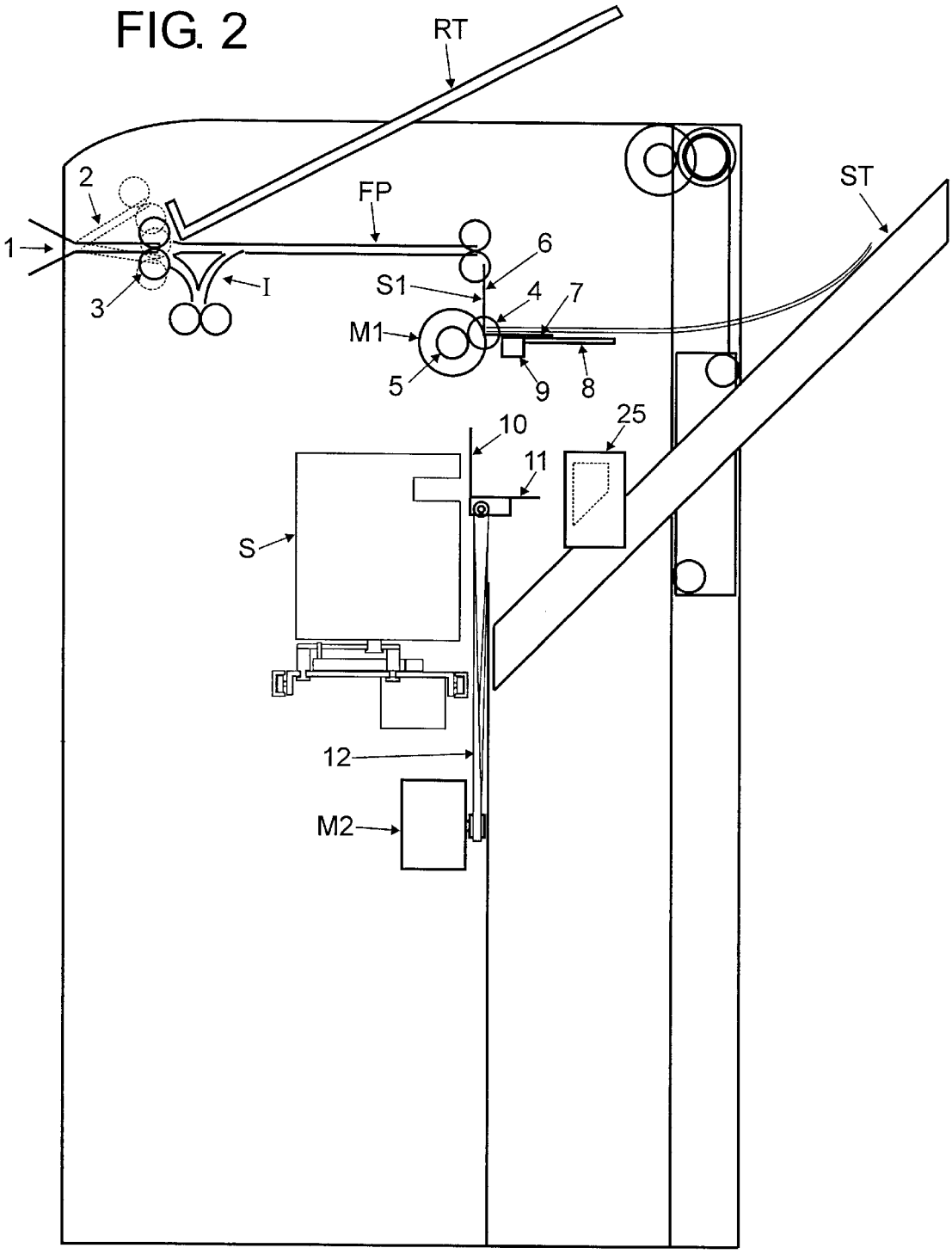
FIG. 2 is a vertical section with the side cover removed to show the internal mechanism, showing a number of sheets fed to the top shelf for assembly.

The apparatus of the invention will be better understood by reference to FIG. 2.

In FIG. 2 the inverter I of the infeed 1 has a gate 2 having driven rolls 3. The gate 2 is pivotal between a broken line position at which sheets will be delivered to the receiving tray RT, a second broken line position for delivery of sheets to the inverter I and a horizontal position for delivery of sheets to the feed path to shelf S1.

Shelf S1 is pivotal for tilting movement on pivots 4, one of which is a roller adapted to be driven by a roller 5 and a motor M1. As shown, the shelf S1 is formed by a normally vertical wall 6 and a normally horizontal wall 7 on which is a centrally located finger 8 which is pivotally movable between a normal position extending horizontally outwardly and to a position beneath the wall 7, as by a solenoid 9.

As seen in FIG. 2, the horizontal extent of shelf wall 7 is such that the trailing ends of sheets supplied through the inlet and the inverter rest on the wall 7 and are further partially supported by finger 8, while the leading ends of the sheets extend forwardly and are supported on the inclined top surface of the stacker tray ST or on sheets previously disposed upon the stacker tray.

Also, as seen in FIG. 2, the lower shelf S2 is of right angular construction and has a normally Vertical wall 10 and a horizontally extended wall 11. Lower shelf S2 is horizontally pivotable by suitable means such as a motor M2 and a linking belt drive 12.

Figure 3:
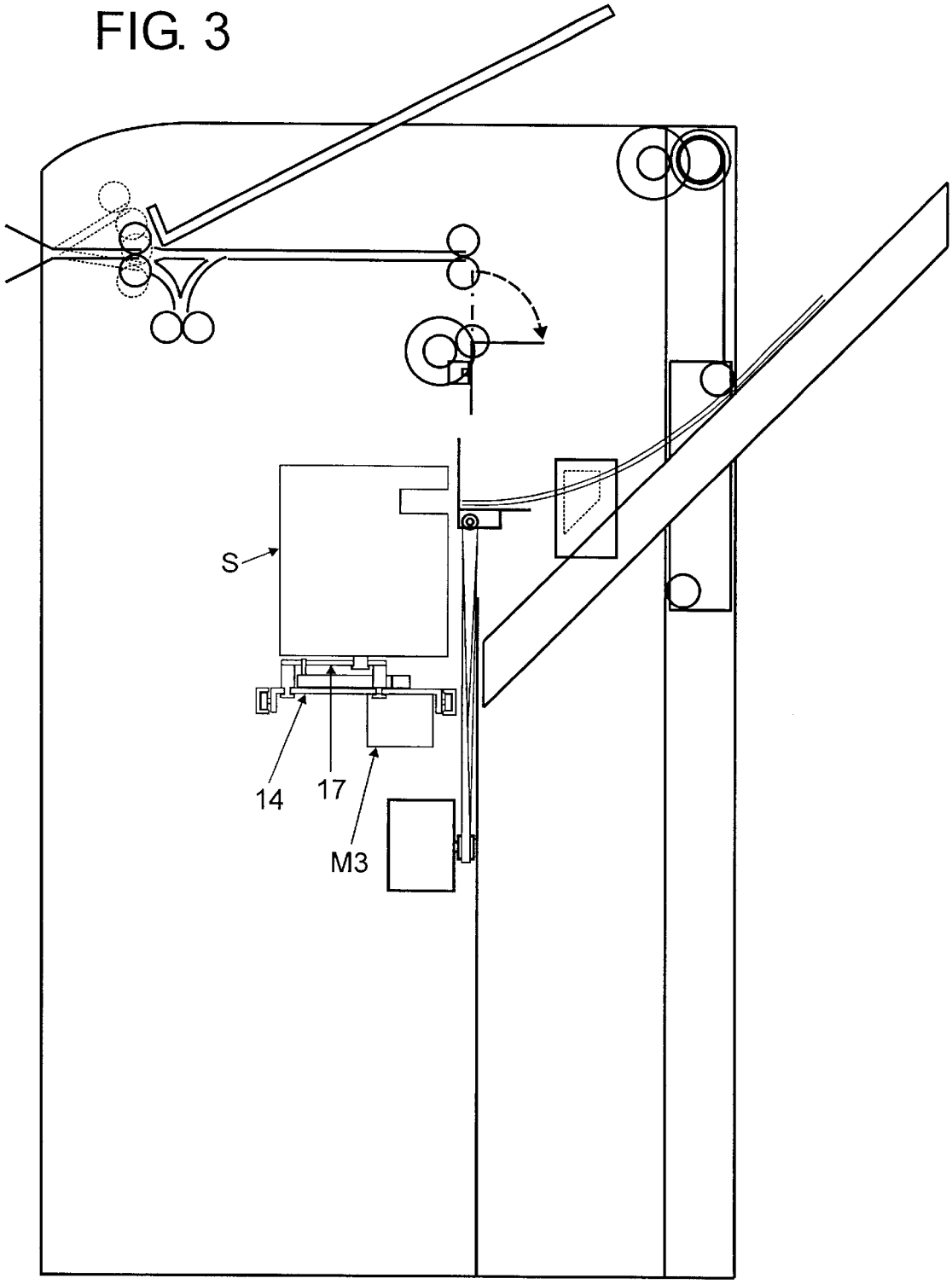
FIG. 3 is a section as in FIG. 2, but showing the first shelf dumped to deposit a number of sheets on the second shelf.
Figure 4:
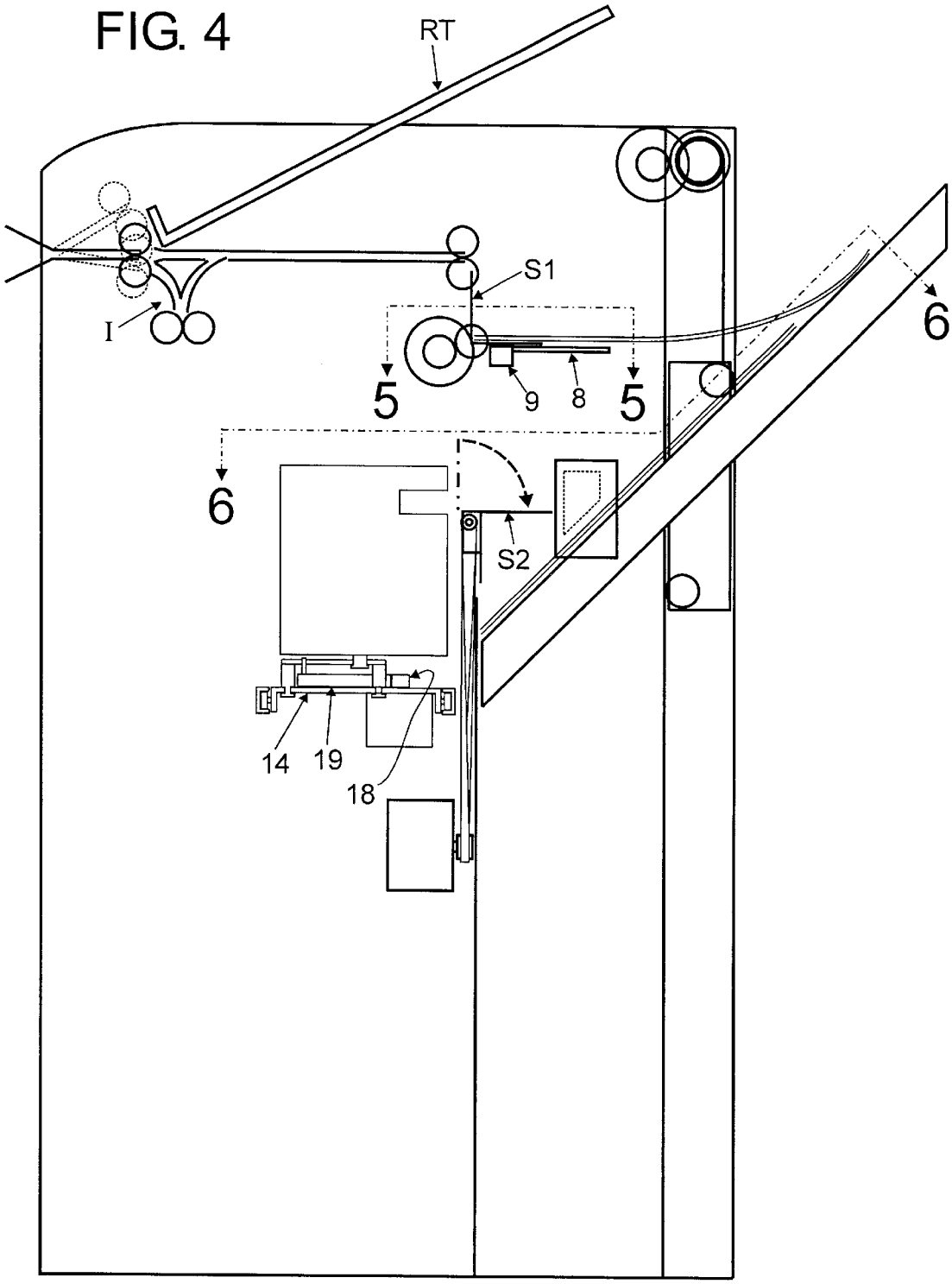
FIG. 4 is a section as in FIG. 3, but showing a set of sheets dumped by the first shelf and in position for offsetting and stapling on the second shelf, as additional sheets are supplied to the first shelf.

When support finger 8 is retracted beneath the upper shelf wall 7 and the upper shelf S1 is pivoted, as shown in FIG. 3, the trailing end of the sheets are dumped and fall downwardly onto and gravitate to the rest on the horizontal wall 11 of shelf S2. As indicated in FIG. 4, following dumping of shelf S1, it is immediately reset to its normal position for reception of additional sheets constituting a portion of the total sheets of a set. Therefore, when a full set is being finished or stapled, the upper shelf will continue to receive a number of the sheets of the next set, so that, at least, the infeed rate of sheets from the printer or copier to shelf S1 will not be impeded.

Figure 5:
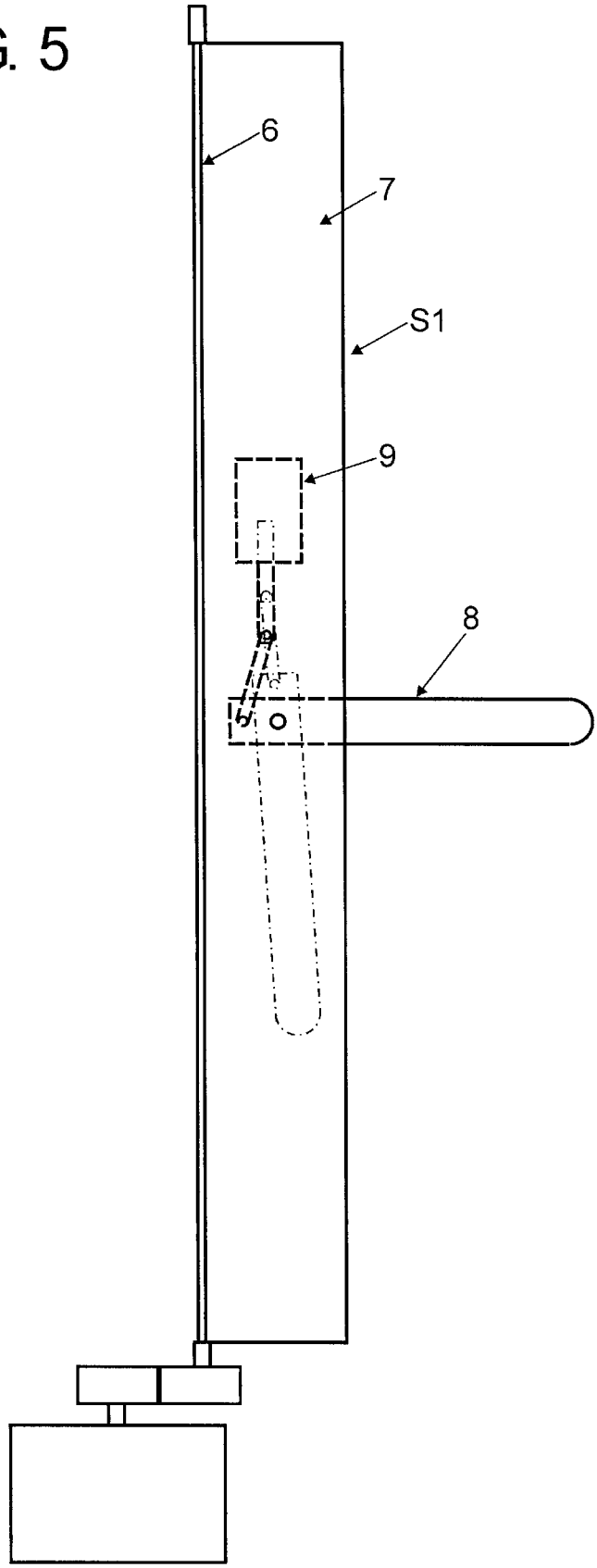
FIG. 5 is a fragmentary horizontal section showing the temporary support associated with the upper shelf for initially supporting the trailing ends of the sheets.

As seen in FIG. 5, the support finger 8 is relatively narrow and extends forwardly of the sheet delivery direction a sufficient distance to preliminarily support the trailing ends of the sheets as they are supplied to the shelf S1 as shown in broken lines, the finger 8, as previously indicated, is actuated to a position beneath the horizontal portion 7 of the shelf S1 by the solenoid 9 or other actuator means to an out of the way position for releasing the trailing ends of the sheets upon downward pivotal movement of the shelf S1 as seen in FIG. 3.

Also, as seen in FIG. 4, the motor M2 is actuated to dump shelf S2 to drop sheets onto the stacker tray, so that a set of sheets on the stacker tray ST can be finished or stapled, on shelf S2, as hereinafter described.

Figure 6:
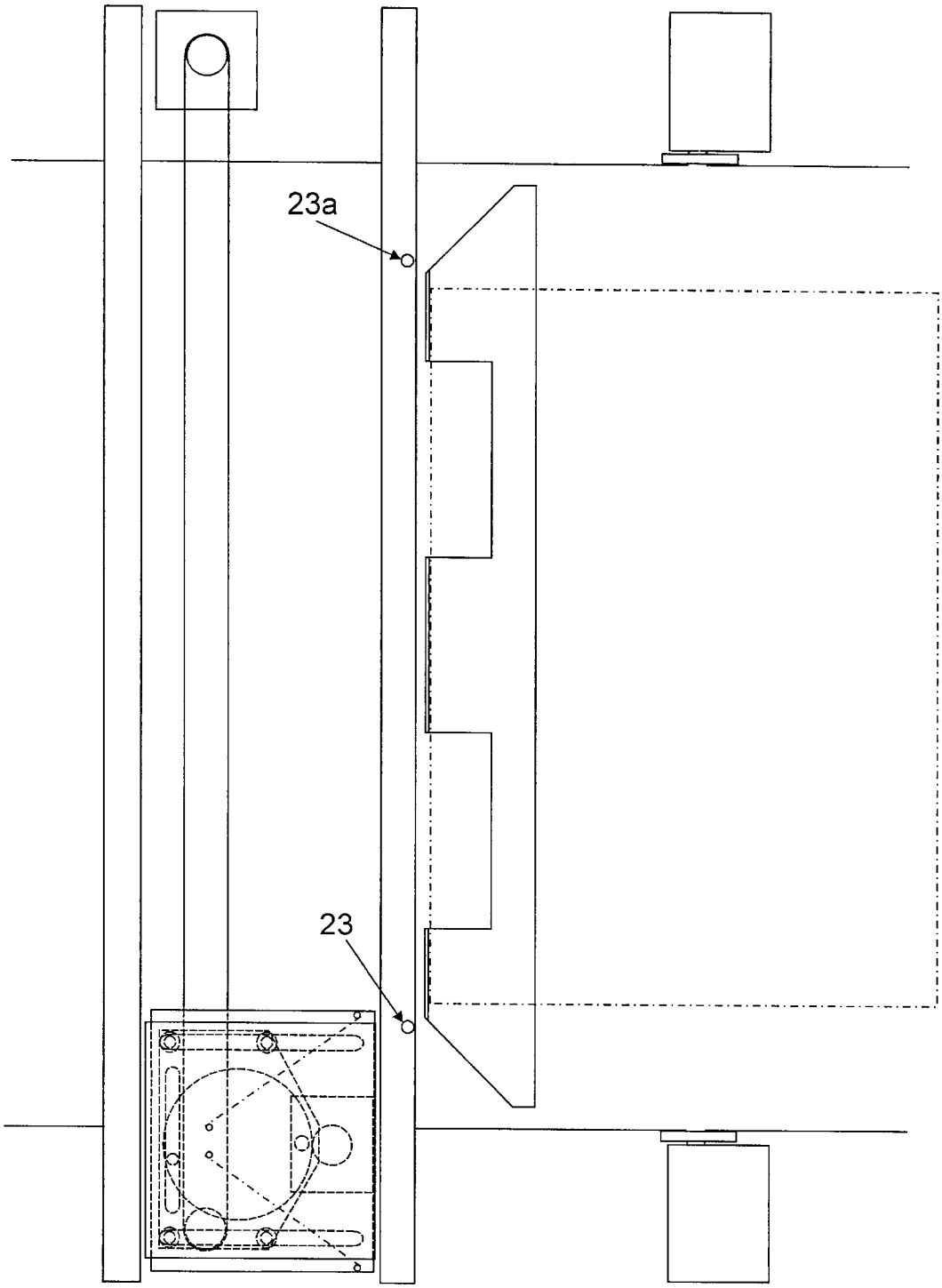
FIG. 6 is a horizontal section, as taken on the line 6—6 of FIG. 4 showing the stapling assembly at one side.
Figure 7:
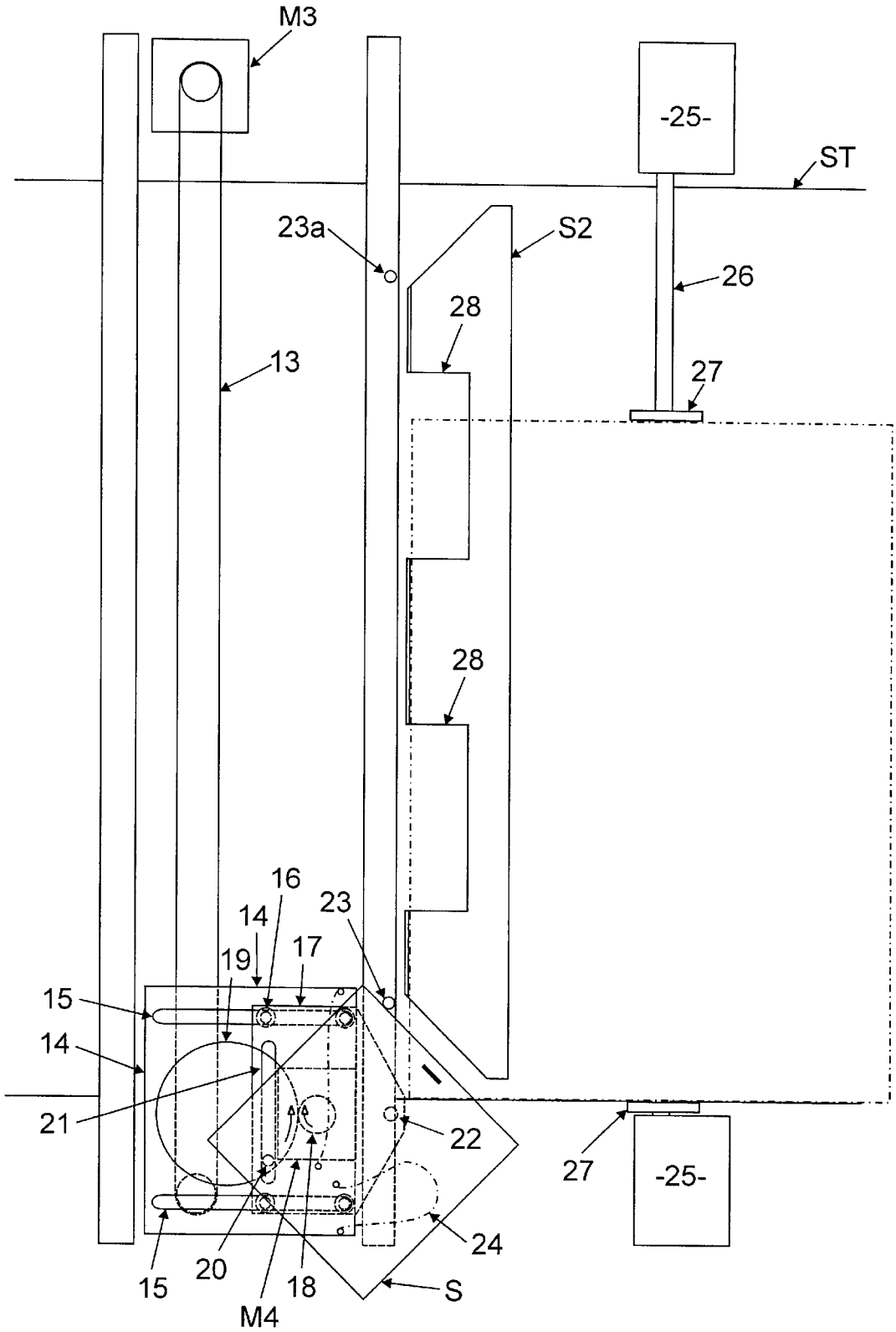
FIG. 7 is a view corresponding to FIG. 6 showing corner stapling of a set of sheets.
Figure 8:
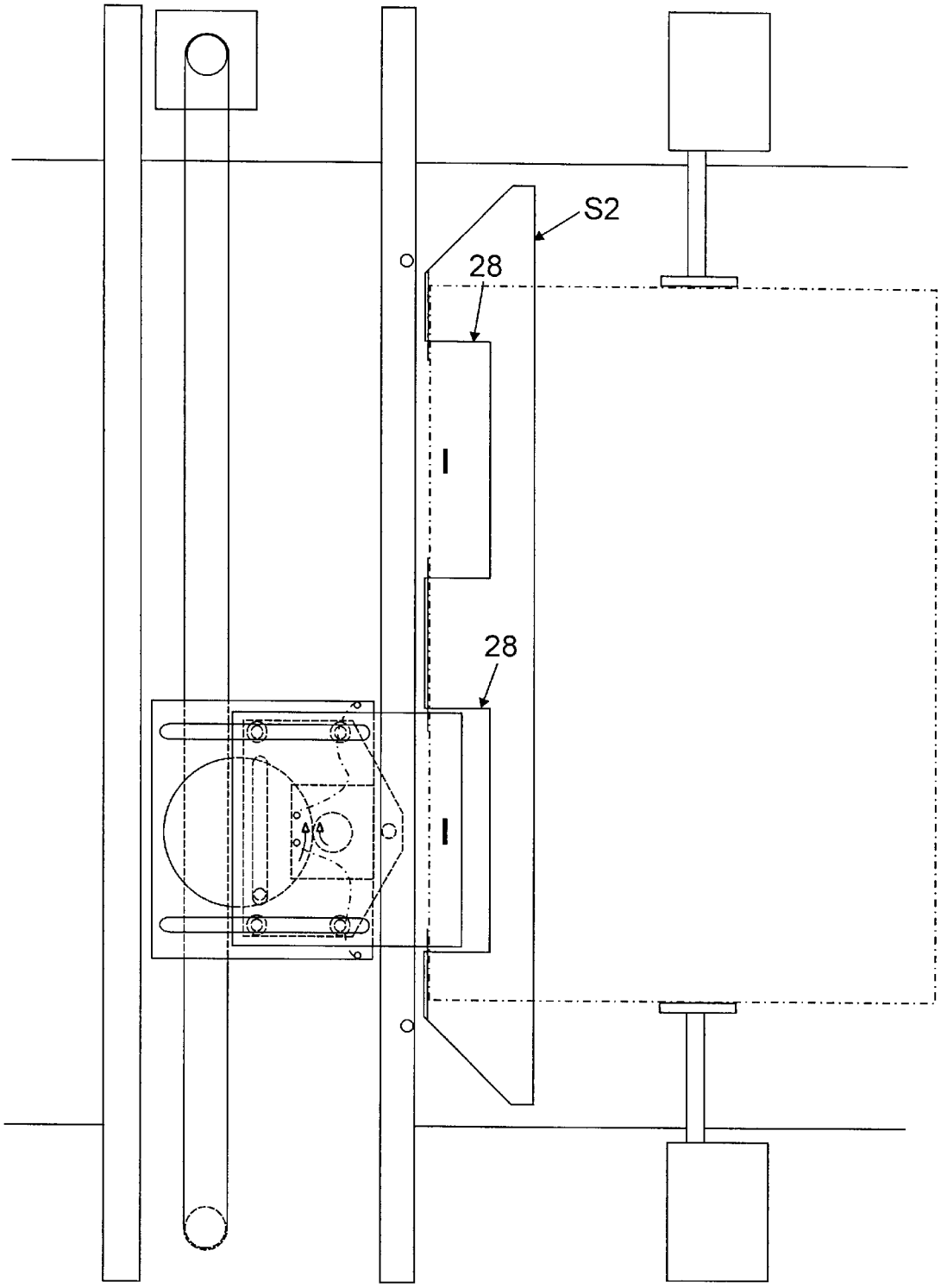
FIG. 8 is a view corresponding with FIG. 6 showing edge stapling of a set in one location.

The stapling mechanism is seen in FIGS. 6, 7 and 8.

As illustrated, the stapling mechanism is adapted to apply a staple to a set of sheets on the stacker tray ST in either corner of the set of sheets or at plural locations along the trailing edge of the set of sheets.

Accordingly, the stapler S is adapted to be translated laterally of the apparatus by a motor M3 and a driven belt 13 to which the stapler S is connected.

As seen in FIG. 7, the stapler S is mounted upon a carriage 14 interconnected with the belt 13 by suitable means and supported on transversely exteded rails and rollers. Means such as a pair of elongated slots 15 and pins 16 shiftable in the slots as the stapler base support 17 is caused to move by drive motor M4. Gearing or rolls 18 and 19 cause pivotal movement of the stapler. The gear 19 has a pin 20 reciprocal in a guide slot 21 so that upon energization of the motor M4 the stapler is caused to pivot about a pivot point 22 into engagement with a stop pin 23, as permitted by a pair of flexible links 24 connected to the stapler.

At the other side of the apparatus is a stop pin 23*a* which is utilized to locate the position of the stapler at the other side of the apparatus during the stapling of the sets of sheets shown in broken lines.

The sets are jogged and aligned by joggers 25 at opposite sides of the apparatus having an extensible steel rule type member 26 driven by the jogger motors 25 towards and away from one another and causing engagement of a pad 27 with the opposite sides of the set of sheets. Such steel rule type joggers are more particularly described and claimed in Coombs, et al U.S. Pat. No. 5,713,566, granted Feb. 3, 1998.

When it is desired to staple sets of sheets, as seen in FIG. 8 along the trailing edge of the set of sheets, the jogging devices are centralized. In addition, the stapler S is actuated by the motor M4 selectively into a pair of notches 28 provided in the shelf S2.

From the foregoing, it will be seen that the present invention provides primarily for the progressive handling or reception of, say, two or more sheets supplied to the upper shelf S1, which upon dumping of shelf S1, deposit on shelf S2 the trailing edge of the sheets on which the set of sheets, when completed, will be finished.

In such an arrangement the fact that the upper shelf receives small numbers of sheets making up a portion of the full set of sheets and continuously drops, say, two sheets from shelf S1 to shelf S2, then the apparatus functions without impeding the speed of the infeed of sheets from the printer or copier.

The apparatus can be controlled in the customary fashion to cause corner stapling, without impeding the input speed of sheets into the apparatus, and depending upon the infeed speed or the provision of an inter-document gap, then the stapler may be used to edge staple the set of sheets without impeding the speed of the printer or copier.

Moreover, the entire set of sheets is not required to drop from shelf S1 to shelf S2, but only the trailing end of the sheets need be dropped as the sets of documents or sheets are being finished on the second or lower shelf, before dumping only the trailing end onto the stacker tray.

What is claimed is:

1. Post processing apparatus for receiving sheets supplied serially from a reproduction machine comprising: infeed means for the sheets entering the apparatus defining an infeed path, an upper shelf having a right angular form, means supporting said shelf for pivotal movement for dumping the trailing ends of a number of sheets therefrom, a second lower shelf disposed vertically beneath the upper shelf and also being of right angular form for receiving the trailing ends of sheets dumped from the upper shelf to the lower shelf, means adjacent to said lower shelf for finishing the sheets on said lower shelf, means supporting said lower shelf for pivotal movement for dumping the trailing ends of a finished set of sheets therefrom, and a stacker tray below said lower shelf for supporting the leading ends of sheets on said upper and lower shelves prior to dumping, respectively, said upper shelf and said lower shelf.

2. Post processing apparatus as defined in claim 1, wherein said stacker tray extends upwardly at an angle from below the lower shelf.

3. Post processing apparatus as defined in claim 1, wherein the finishing means is a stapler translatable relative to said lower shelf for stapling in either corner or in the middle of the sheets while the trailing ends of finished sets of sheets are supported on the second shelf.

4. Post processing apparatus as defined in claim 1, wherein a retractable finger partially supports the center of the sheets between the upper shelf and the stacker tray.

5. Post processing apparatus as defined in claim 1, including jogging means for jogging and offsetting sheets on said stacker tray.

6. A post processing apparatus for receiving sheets supplied serially from a document processing machine comprising:

an infeeder unit defining an infeed path for the sheets entering the post processing apparatus from the output of the document processing machine;

an upper shelf positioned to support first ends of the sheets, the upper shelf being pivotally supported for pivotal movement for dumping the first ends of a number of sheets from the upper shelf;

a lower shelf disposed vertically beneath the upper shelf and positioned to receive the first ends of sheets dumped from the upper shelf to the lower shelf;

a finishing unit adjacent to the lower shelf and adapted to finish the sheets on the lower shelf;

the lower shelf being pivotally supported for pivotal movement for dumping the first ends of the finished sheets therefrom; and, a stacker tray below the lower shelf and positioned such that a portion of the stacker tray supports the second ends of sheets while the first ends are supported, respectively, on the upper and lower shelves prior to dumping, respectively, the upper shelf and the lower shelf.

7. A post processing apparatus as defined in claim 1, wherein the stacker tray extends upwardly at an angle from below the lower shelf.

8. A post processing apparatus as defined in claim 1, wherein the finishing unit comprises a stapler translatable relative to the lower shelf and adapted to staple in selected locations on the sheets while the first ends of finished sets of sheets are supported on the lower shelf.

9. A post processing apparatus as defined in claim 1, wherein a retractable finger partially supports the center of the sheets between the upper shelf and the portion of the stacker tray supporting the second ends of the sheets.

10. A post processing apparatus as defined in claim 1, further comprising a registering mechanism adapted to register sheets on the lower shelf.

* * * * *